US005842830A

United States Patent [19]

Franznick

[11] Patent Number: 5,842,830

[45] Date of Patent: Dec. 1, 1998

[54] HOLLOW SHAFT KAYAK PADDLE

[75] Inventor: Philip Christopher Franznick, Flagstaff, Ariz.

[73] Assignee: Zuzu Paddle Company, Inc., Flagstaff, Ariz.

[21] Appl. No.: 783,150

[22] Filed: Jan. 14, 1997

[51] Int. Cl.[6] ..... B63H 16/04

[52] U.S. Cl. ..... 416/74; 416/229 R; 440/101

[58] Field of Search ..... 416/69, 70 R, 416/71, 74, 229 R; 440/101; 464/179, 183; D12/215

[56] References Cited

U.S. PATENT DOCUMENTS

| | | | |
|---|---|---|---|
| 887,160 | 5/1908 | Webb | 464/183 |
| 1,003,069 | 9/1911 | Shea | 416/74 |
| 2,353,662 | 7/1944 | Goldman | 416/71 |
| 3,091,781 | 6/1963 | Wisbro | 416/70 R |
| 4,820,216 | 4/1989 | Masters | 416/70 R |
| 4,863,416 | 9/1989 | Gupta | 464/183 |
| 5,649,845 | 7/1997 | Fechtner | 441/56 |

FOREIGN PATENT DOCUMENTS

| | | | |
|---|---|---|---|
| 32433 | 7/1885 | Germany | 416/74 |
| 506719 | 12/1954 | Italy | 416/74 |
| 12370 | of 1907 | United Kingdom | 416/74 |

*Primary Examiner*—Christopher Verdier
*Attorney, Agent, or Firm*—Hoffman & Baron, LLP

[57] ABSTRACT

A kayak paddle with a hollow wooden shaft featuring reduced weight and improved strength. The shaft is formed from lineal segments which run the entire length of the paddle shaft and are joined to form a closed shaft structure. A helical twist can be introduced in the shaft to establish desired paddle "feather." The hollow shaft can be formed having a closed cell foam core wrapped with a reinforcing cloth, such as fiberglass to further increase the strength of the shaft.

29 Claims, 5 Drawing Sheets

30
2
B
A
50
53
D
52
C
30
B
A
50
C
D
52

HOLLOW SHAFT KAYAK PADDLE

BACKGROUND OF THE INVENTION

The present invention relates generally to both paddles and hollow shafts, and more particularly relates to a kayak paddle having a hollow shaft and a method for making the same.

Wooden kayak paddles are well known in the art. For example, U.S. Pat. No. 4,610,633 to Freudenberg illustrates a two-blade kayak paddle having a wooden shaft. The shaft in the Freudenberg reference is a solid core structure formed from a laminate of several elongate pieces bonded together. The shaft is formed in two sections, onto each of which a paddle blade is attached. Typically, the shaft sections have an ovular or elliptical cross section having a major cross sectional dimension and a minor cross sectional dimension. The paddle blades, which are essentially planar, are attached to each shaft segment such that the plane of the blade is perpendicular to the major cross sectional dimension of the shaft.

Each shaft section and blade forms a paddle half. The two paddle halves are joined together with a diagonal splice joint located in the center of the resulting paddle shaft. The two halves are joined together so that the plane of one blade is at a specific angle to the plane of the other. This relative paddle angle is referred to as the "feather" of the kayak paddle. The specific angle varies, but is typically in the range of 45°–90°. Having one blade feathered with respect to the other affords the paddler reduced wind resistance on the exposed blade while taking a stroke with the other paddle blade. However, as a result of the center splice joint, the Freudenberg reference presents a potential point of weakness at the center of the paddle shaft where the two halves are joined.

Kayak paddles have also been fabricated from materials other than wood. For example, U.S. Pat. No. 4,605,378 to Hamilton illustrates a kayak paddle having a two piece hollow shaft formed from metal or fiberglass. The shaft in the Hamilton reference is capable of being separated into two shaft segments for storage. U.S. Pat. No. 4,673,361 to Harvey also illustrates the fabrication of a kayak paddle from materials other than wood. The paddles disclosed in the Harvey reference include pronounced loop-like handles interposed within a plastic or metal shaft. While shafts made of alternative materials may offer reduced weight, many paddlers prefer the dynamic characteristics of wooden shafted paddles. Therefore, it would be desirable to provide a kayak paddle which offered both reduced weight as well as the desirable characteristics of wood.

The problem of reducing the weight of an elongate wooden structure was addressed in U.S. Pat. No. 377,490 to Mansfield. The Mansfield reference is directed to mast and spar structures for sailing ships. The structures are formed from a multiple of elongate wooden segments. The segments are joined edge wise to form a substantially cylindrical hollow shaft. Because the resulting shaft is hollow, a mast or spar structure formed according to the Mansfield reference features reduced weight per unit diameter. However, the Mansfield reference does not disclose the formation of a shaft having an ovular cross section nor does it address the need to feather the kayak paddle blades. Therefore, the shaft structures of the Mansfield reference are not well suited to the art of kayak paddle construction.

U.S. Pat. No. 336,255 to Nichols is also directed to forming elongate wooden structures. The Nichols reference discloses the fabrication of "whip stock" by joining lineal segments of dissimilar woods to obtain an elongate structure with the characteristics of each of the materials used. However, the Nichols reference is only directed to thin, solid and substantially cylindrical shafts such as fishing pole tips. As with the Mansfield reference, there is no teaching in Nichols to form a structure having an ovular cross section or a method of implementing the feathering required in a kayak paddle.

SUMMARY OF THE INVENTION

The present invention provides a hollow elongate shaft especially well suited for use in a kayak paddle. The shaft is formed by joining at least two elongate segments in side-to-side relationship to provide a substantially continuous outside surface and a hollow shaft interior.

In one preferred embodiment of the present invention, a shaft is formed with a helical twist therein. This is achieved by assembling, in side-to-side relationship, at least two lineal segments. Each of the segments having two sides with slidable mating surfaces. Once assembled, the segments form a shaft having a central axis and first and second ends. The first and second ends are rotationally displaced about the central axis to introduce a helical twist into the shaft. The shaft is then permanently seized while twisted, to prevent untwisting. When used as a kayak paddle shaft, a blade is mounted to each end of the shaft. As a result of the helical twist introduced in the shaft, the paddle blades will be feathered by the degree of rotational displacement introduced into the shaft.

Another embodiment of a shaft formed in accordance with the present invention includes a center core disposed within the hollow shaft interior. The center core is preferably formed from a material having a mass which is less than the mass of the material used to form the lineal segments. Preferably, the shaft further includes a reinforcing material which is disposed between the center core and the shaft interior. The reinforcing material bonds to the shaft interior forming a reinforcing sleeve therein.

It will be appreciated by those skilled in the art that a kayak paddle formed in accordance with the present invention is significantly lighter than wooden kayak paddles of the prior art while retaining the paddle dynamics of wooden paddle shafts.

A further advantage of the present invention is that the paddle blades of the kayak paddle formed in accordance with the present invention may be feathered without the use of a splice joint in the center of the shaft. This eliminates a point of weakness in wooden paddle shafts known in the prior art. The elimination of the center splice also provides a more uniform flex pattern in the resulting kayak paddle.

For better understanding of the present invention, together with other and further advantages, reference is made to the following description taken in conjunction with the accompanying drawings, and its scope will be pointed out in the appended claims.

BRIEF DESCRIPTION OF THE DRAWINGS

FIG. 5A illustrates the mold prior to introducing the helical twist, FIG. 5B illustrates the mold post twisting.

DETAILED DESCRIPTION OF THE INVENTION

Figure 1:
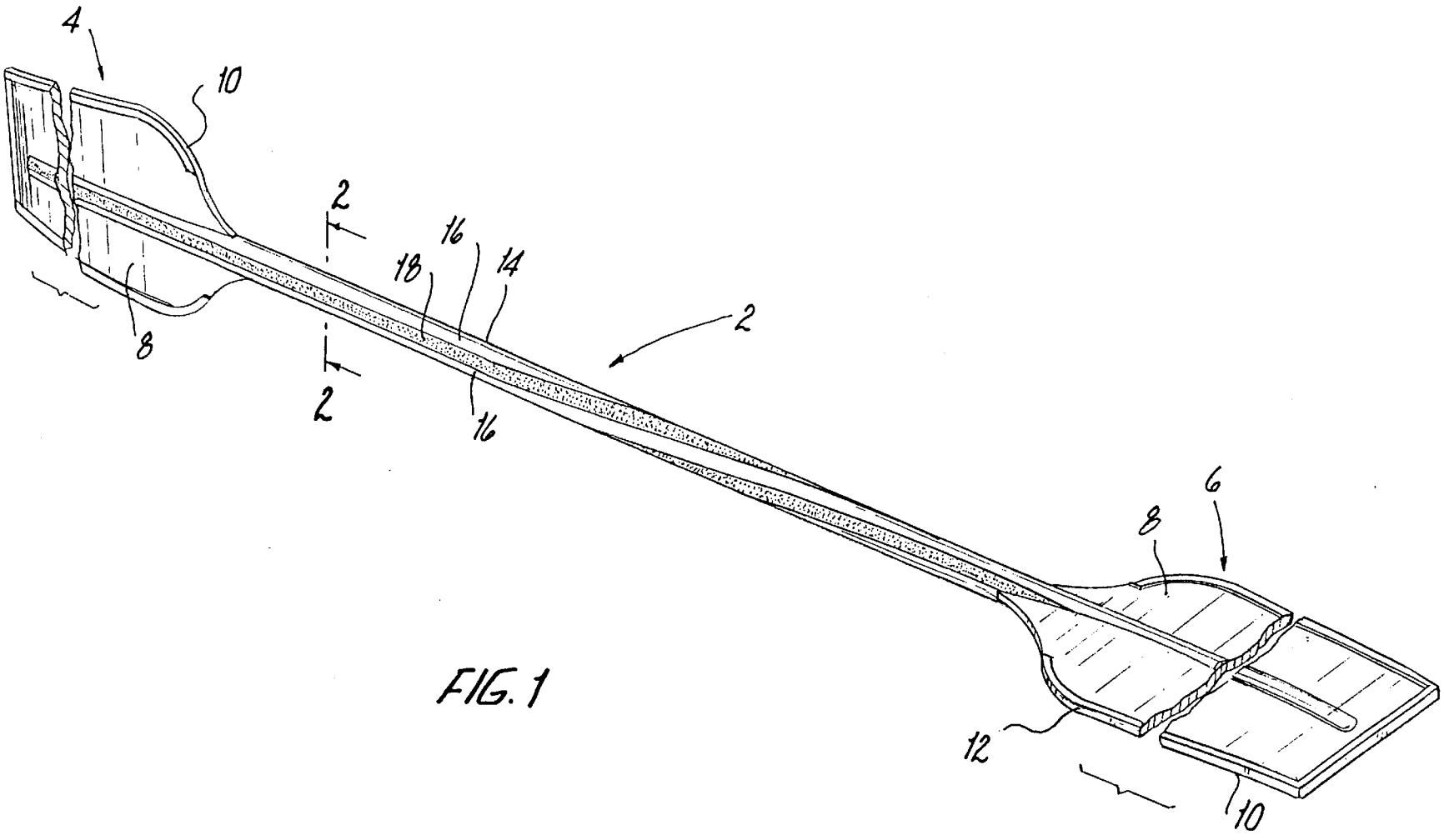
FIG. 1 is a perspective view of a kayak paddle formed in accordance with the present invention.

Referring to the drawings, FIG. 1 illustrates a perspective view of a kayak paddle formed in accordance with the present invention. The paddle includes a shaft 2 and two paddle blades 4, 6. Each of the paddle blades 4, 6 is a substantially planar structure having a front side 8, a back side 10 and an edge surface 12 defining the perimeter of the front and back side. The paddle blades 4, 6 are rotationally displaced (feathered) in the illustration of FIG. 1 such that the front surface 8 of paddle blade 4 is substantially orthogonal to the front surface 8 of paddle blade 6. The rotational displacement is achieved by forming the shaft 2 with a helical twist therein.

Figures 2, 2B:
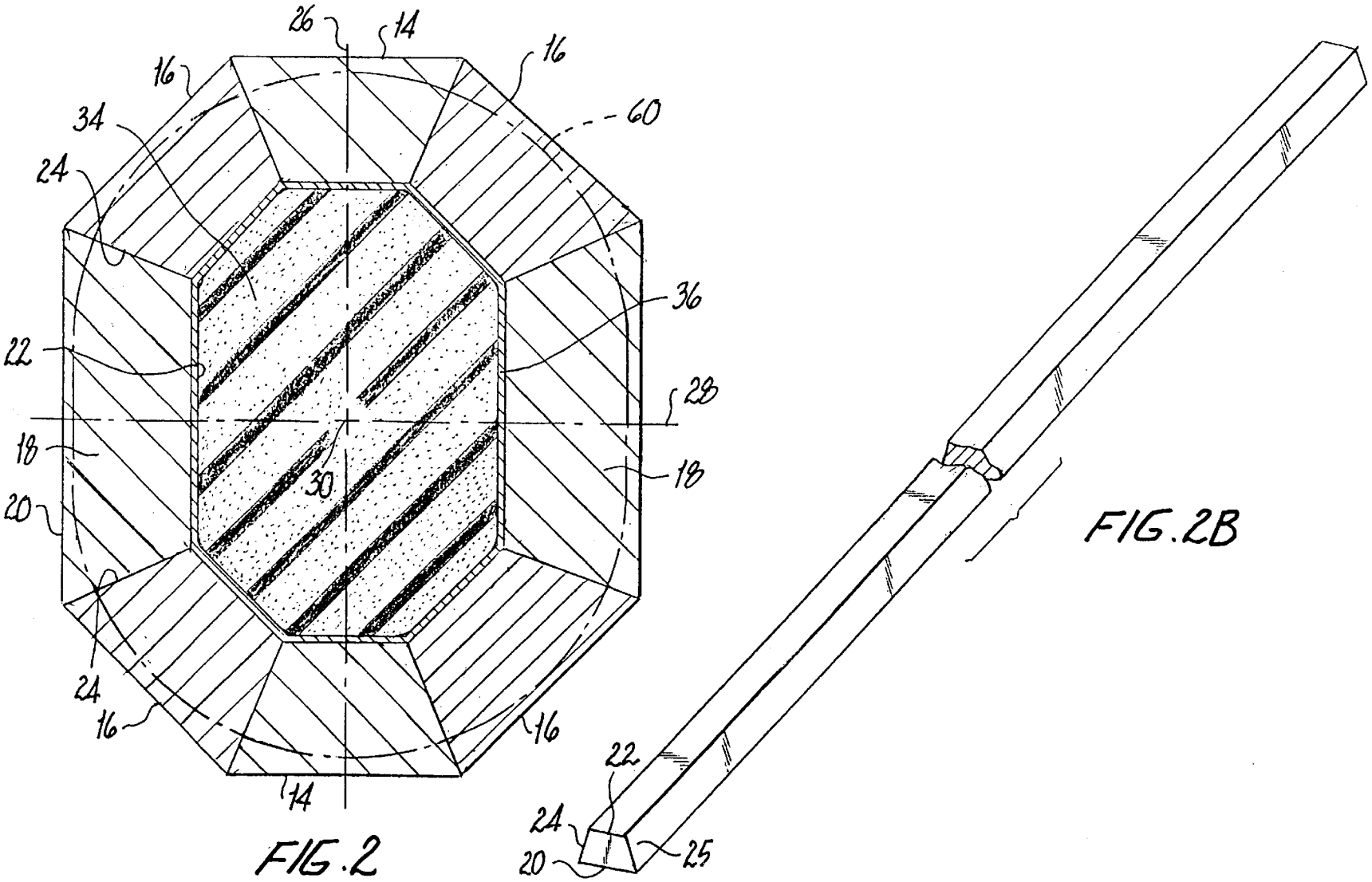
FIG. 2 is a cross-sectional view of a shaft, formed in accordance with the present invention, taken along line 2—2 of FIG. 1.
FIG. 2B is a perspective view of a typical lineal segment used to form a shaft in accordance with the present invention.

FIG. 2 illustrates the construction of the shaft 2 in a cross-sectional view taken about line 2—2 of FIG. 1. Referring to FIG. 2, the shaft 2 is shown formed from multiple lineal segments 14, 16, 18 which are joined to form a hollow wooden shaft 2. Each segment 14, 16, 18 has a length and, in a preferred embodiment, has a substantially trapezoidal cross-section. The cross-section is defined by an exterior base 20, an interior base 22 and two nonparallel legs 24. The length of each segment 14, 16, 18 is at least as long as the finished shaft 2. The exterior base 20 and shaft length define an exterior segment surface. The interior base 22 and shaft length define an interior segment surface. Further, each segment has two mating surfaces 25 defined by the legs 24 and the length of the shaft segments 14, 16, 18. The segment surfaces are best illustrated in the perspective view of the segments shown in FIG. 2B. When segments 14, 16, 18 are formed as trapezoids, the exterior base 20 is selected to be larger than the interior base 22. Preferably, the angle formed between the legs 24 and the exterior base 20, are equal. Other segment geometries may be used so long as the angles are selected such that segments 14, 16, 18 form a closed shaft when assembled.

In a preferred embodiment illustrated in FIG. 2, an octagonal cross-section is formed from eight lineal segments. In a kayak paddle, it is desirable for the shaft to be ovular or elliptical in cross-section so that a paddler can readily feel the paddle alignment in his or her hands. In the present invention, this is achieved by forming two of the segments 18, which oppose one another in the assembled shaft 2, with a larger exterior base 20 then that of segments 14 and 16. This results in shaft 2 having a cross-section with a major axis 26 which is longer than a second, perpendicular, minor axis 28. A center axis 30, is located at the intersection of the major axis 26 and minor axis 28 and runs normal to these axes, i.e., along the shaft length.

To further reduce the weight of the shaft 2, the segments 14, 16, 18 can be formed from dissimilar materials. A preferred combination is to use a hard wood, such as ash, for segments 14 and 18, and interpose a soft wood, such as spruce or basswood, for segments 16. The soft woods are lighter and reduce the overall shaft weight while the strength of the paddle is preserved by the hard wood segments. Alternatively, other materials, such as carbon fiber, may be used to fabricate one or more segments. Such a mixed composition could form a shaft with unique flex and strength characteristics.

The paddle blades 4, 6 are preferably joined to the shaft with the edge surface 12 substantially aligned with the minor axis 28. This alignment places the planar surfaces 8, 10 of the paddle blade perpendicular to the major axis 26. If a helical twist is introduced in the shaft 2, as is shown in FIG. 1, paddle blade 4 will be feathered with respect to paddle blade 6. As a result of the helical twist, the paddle blades are feathered without introducing the center splice in the paddle shaft.

Figure 3A:
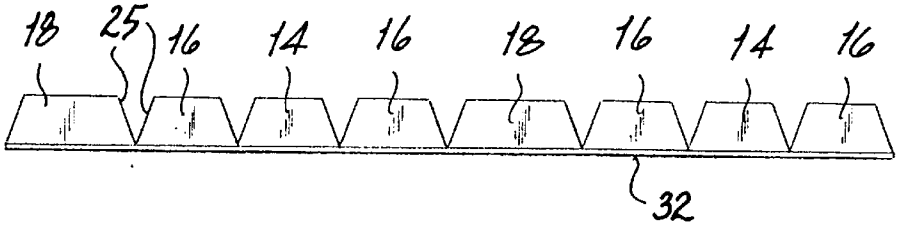
FIGS. 3A and 3B are cross-sectional views of a shaft being formed in accordance with the method of the present invention.
Figure 3B:
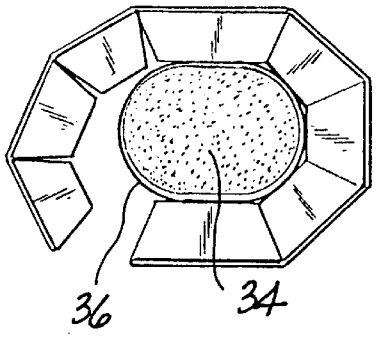

A preferred method of fabricating the shaft 2 is illustrated in FIGS. 3A and 3B. Shaft segments 14, 16, 18 are laid out in side-to-side relationship with the exterior surfaces of the segments placed in a substantially planar arrangement. An adhesive backed material 32 (i.e., tape) is applied to the exterior base surfaces which temporarily join the segments together. The surfaces 25 of adjacent segments 14, 16, 18 form grooves in which an adhesive material, such as an epoxy resin, is applied. Preferably, the epoxy resin is a two-part marine grade wood epoxy with a long curing time, such as that manufactured by Smith and Company. After the adhesive is applied, the planar structure of FIG. 3A is rolled into a closed structure as is illustrated in FIG. 3B.

Figure 4:
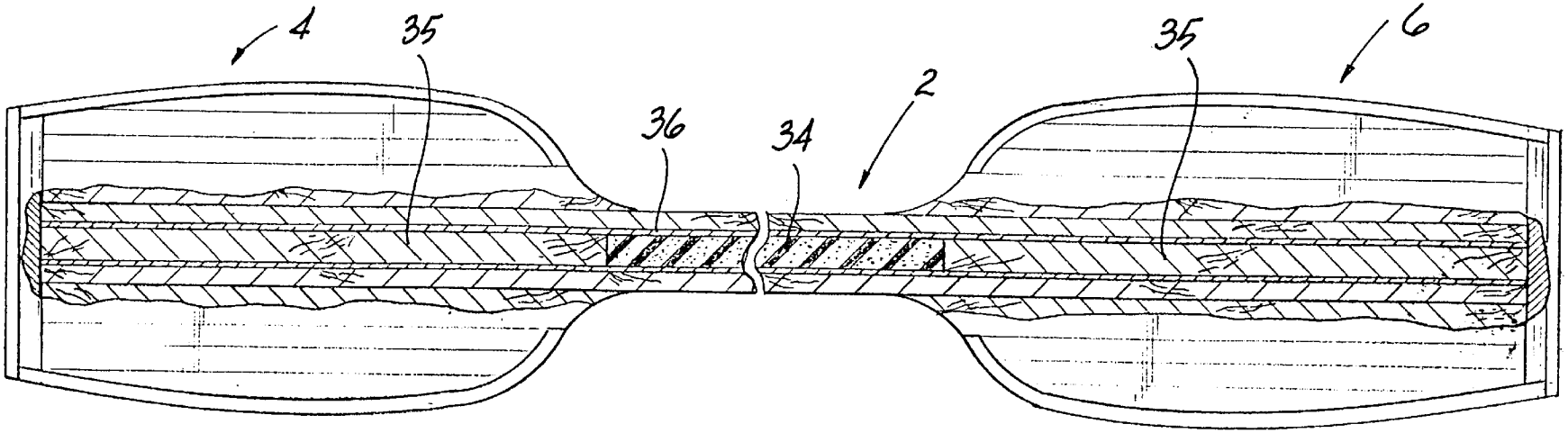
FIG. 4 is a cross-sectional view of a kayak paddle formed in accordance with the present invention.

In a preferred embodiment illustrated in FIG. 4, two end plugs 35 and a central core 34 are placed within the structure prior to closing. The end plugs 35 are typically formed from a hard wood and extend into the shaft. Each end plug 35 preferably extends into the shaft 2 by a length which slightly exceeds that of the paddle blade 4, 6 to be attached. This provides a solid wooden area in the shaft which will be contoured into the blade surface 8, 10.

The central core 34 is preferably formed from a material which has less mass (thus lighter) than that of the wood used to form segments 14, 16, 18. A light weight closed cell foam is preferred, but other materials, such as cork, may also be employed. The material selected for the central core 34 is preferably one which is deformable. When a deformable material is used, the core 34 may be formed with a cross section which is round or ovular. Upon closing the shaft, the deformable core will be compressed and conform to the interior cross section of the shaft 2. Alternatively, the central core 34 may be formed to substantially comply with the interior cross section of the shaft 2 such that deformation of the core 34 upon closure of the shaft is not required.

The central core 34 may further be wrapped with a reinforcing material 36 such as fiberglass cloth or carbon fiber cloth. When the central core 34 and reinforcing material 36 are used, excess adhesive will wet out from the grooves upon closure and will be absorbed by the reinforcing material 36. The adhesive and reinforcing material 36 will cooperate to form a reinforcing sleeve which bonds to the interior surface of the shaft 2 when the adhesive cures.

Figure 4A:
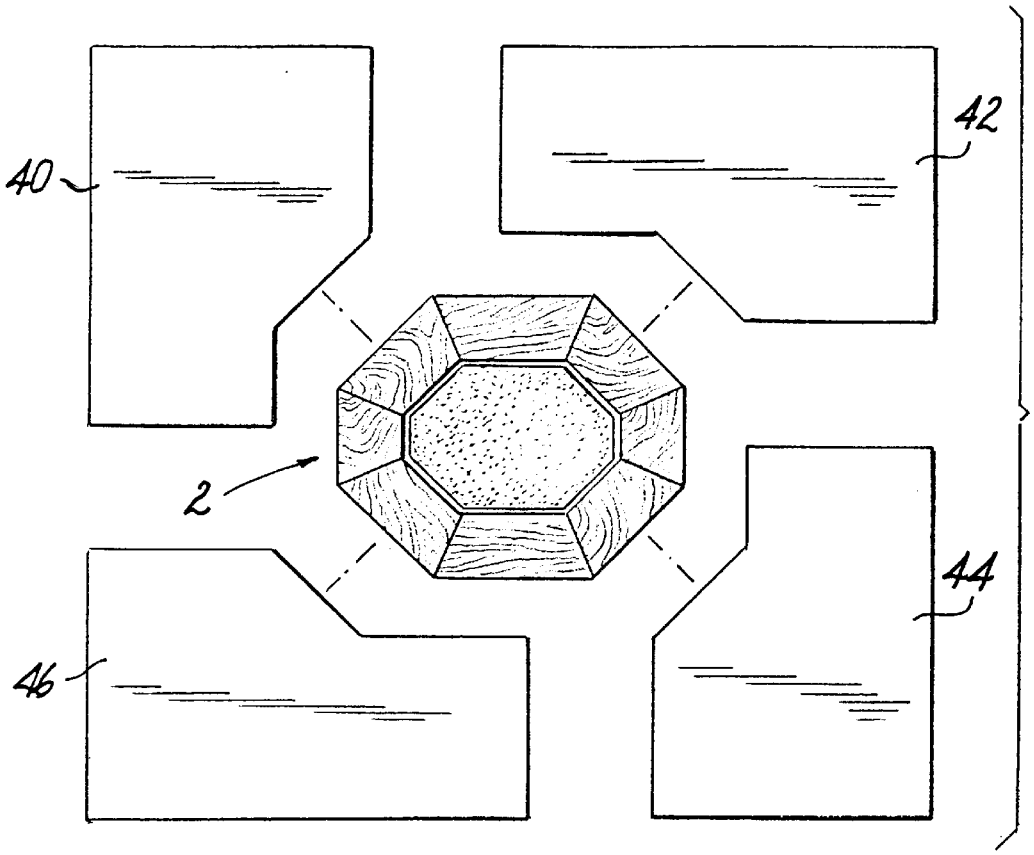
FIGS. 4A and 4B are cross-sectional views of a four-piece mold in cooperation with a shaft, used to introduce a helical twist in the shaft in accordance with the present invention.
Figure 4B:
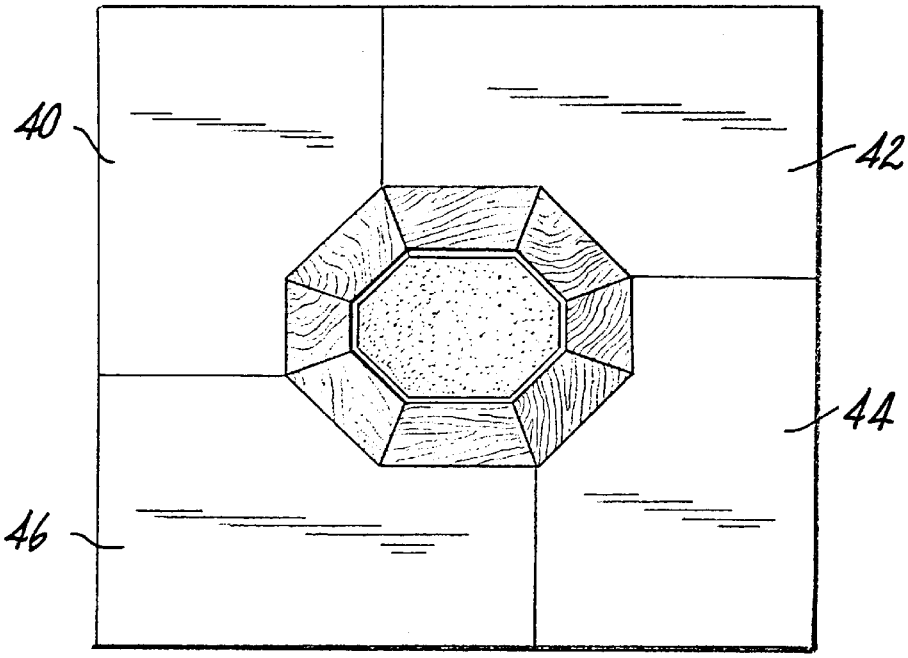

As previously discussed, in a kayak paddle, it is desirable to "feather" the paddle blades with respect to one another. It also desirable to maintain the alignment of the blades perpendicular to the major cross-sectional axis 26 of the shaft 2. To achieve the desired feather and paddle blade to shaft alignment, a helical twist is introduced into the shaft 2 of the present invention. The helical twist can be introduced by placing the closed structure of FIG. 3B into two mold halves illustrated in FIGS. 4A, 4B, SA and 5B. Preferably each mold half is composed of four mold segments 40, 42, 44, 46 which are sized and shaped to receive and capture the exterior cross-section of the shaft 2 when assembled. The four-piece mold construction allows the mold to tightly hold the shaft even with variation in the shaft cross section. FIG. 4A illustrates the mold segments 40, 42, 44, 46 about to engage the shaft 2. FIG. 4B illustrates the mold segments properly engaged about the shaft 2.

Figures 5A, 5B:
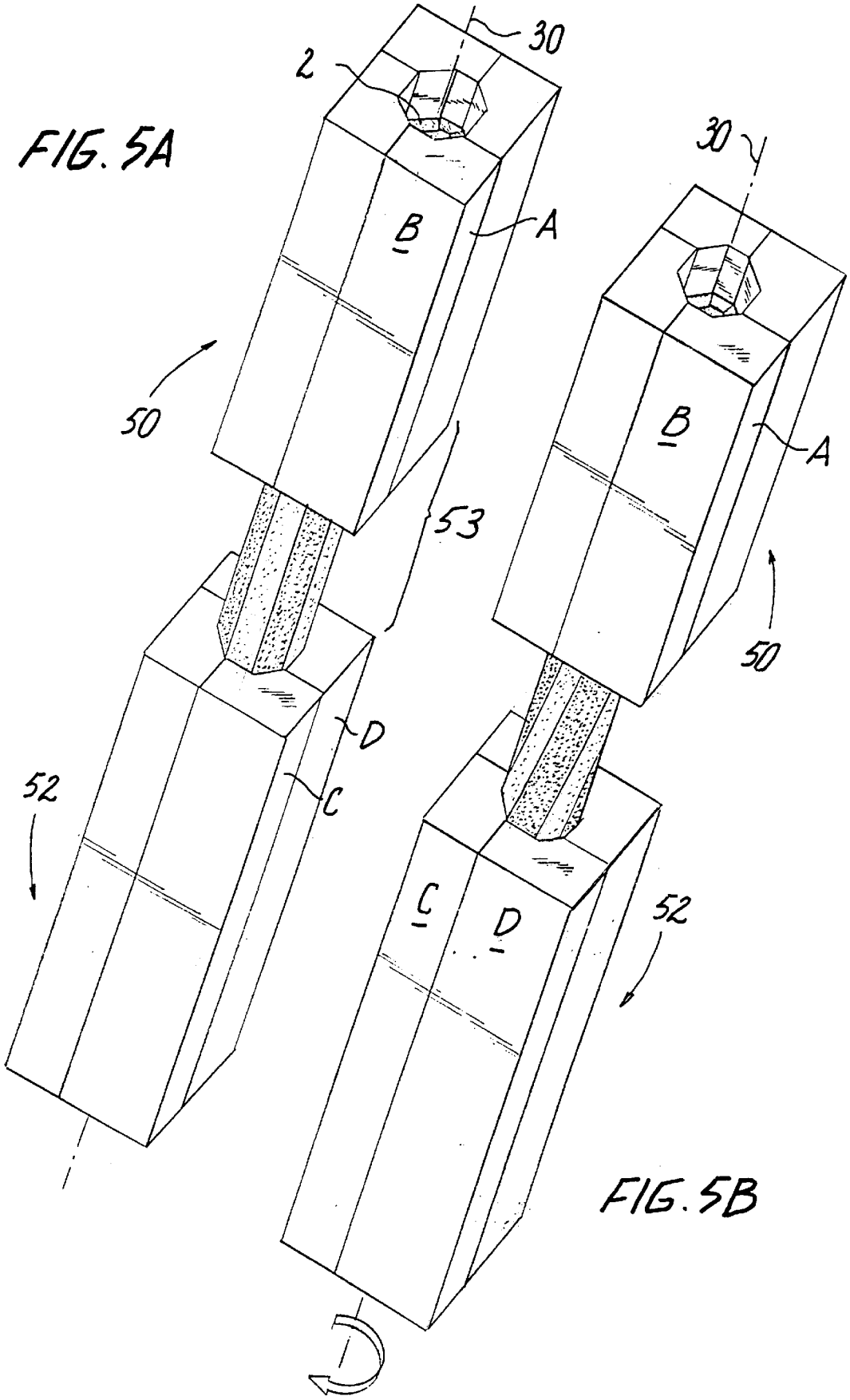
FIGS. 5A and 5B are perspective views of the mold of FIGS. 4A and 4B, shown in cooperation with a shaft.

Referring to FIG. 5A, the shaft 2 with two mold halves attached is illustrated before introduction of the helical twist. Surfaces labeled A and B on mold half 50 and surfaces labeled C and D on mold half 52 show the relative position of the mold halves before twisting (FIG. 5A) and after twisting (FIG. 5B). The two mold halves 50, 52 are clamped about the shaft 2 with a gap 53 between the two mold halves. The gap 53 is the area within the shaft 2 which will receive the helical twist. Therefore, the gap 53 must be large enough to accommodate the required twist. For a kayak paddle shaft having a feather angle of 45°–90° the gap 53 currently used to practice the invention is approximately twenty inches.

To introduce the helical twist, one of the mold halves 50 is preferably held in a static position while the second mold half 52 is rotated about the central axis 30 of the shaft 2. The rotation is introduced while the adhesive on the shaft segments is still in a compliant state. During rotation, the surfaces 25 of adjacent shaft segments slidably engage with one another. The mold halves 50 and 52 are maintained in a relative twisted position until the adhesive cures, thus permanently seizing the shaft in the twisted position. By comparing FIGS. 5A and 5B, it can be seen that surfaces C and D of mold half 52 rotate about the central axis from a first position as shown in FIG. 5A to the twisted position illustrated in FIG. 5B. The degree of rotation is preferably in the range of 45°–90° to achieve the desired paddle feather in a finished shaft 2.

If the resulting shaft 2 is to be used as a kayak paddle shaft, it is desirable to machine off the angular surfaces which result from forming the shaft from trapezoidal segments. The machining step can be done with conventional wood working tools and in a conventional fashion to establish an ovular or elliptical cross-section having a helical twist about the length of the shaft. A typical final outline of the completed shaft is illustrated by the outline 60 illustrated in FIG. 2.

A kayak paddle shaft formed in accordance with the present invention features reduced shaft mass due to the hollow construction. This allows either a lighter kayak paddle to be made, or a kayak paddle to be made with equivalent mass but with increased rigidity as mass is shifted from the neutral axis of the shaft to the circumference of the shaft. Further, as a result of the construction of the present invention, the central splice typically used in conventional kayak paddles is eliminated. This results in enhanced resilience, strength and a more uniform flex pattern about the length of the shaft.

While there have been described what are presently believed to be the preferred embodiments of the invention, those skilled in the art will realize that various changes and modifications may be made to the invention without departing from the spirit of the invention and it is intended to claim all such changes and modifications as forward in the scope of the invention.

What is claimed:

1. A kayak paddle comprising:

an elongate hollow shaft having a first end, a second end and a length, said shaft being formed from at least two lineal segments in a side-to-side relationship to provide a substantially continuous outside surface and a hollow shaft interior;

a first paddle blade, said first paddle blade being attached to said first shaft end; and a second paddle blade, said second paddle blade being attached to said second shaft end.

2. A kayak paddle, as defined by claim 1, further comprising a center core, said center core being disposed within said hollow shaft interior, said segments being formed from at least a first material having a first mass, said center core being formed from a second material having a second mass, said second mass being less than said first mass.

3. A kayak paddle, as defined by claim 2, further comprising a reinforcing material, said reinforcing material being disposed between said center core and said hollow shaft interior, said reinforcing material bonding to said shaft interior forming a substantially rigid interior sleeve.

4. A kayak paddle, as defined by claim 3, wherein said at least two lineal segments further comprise eight lineal segments, said segments having a substantially trapezoidal cross section.

5. A kayak paddle, as defined by claim 4, wherein said segments are formed from wood and said center core is formed from closed cell foam.

6. A kayak paddle comprising:

an elongate hollow shaft having a first end, a second end, a length and a center axis along said length, said shaft being formed from at least two lineal segments in a side-to-side relationship to provide a substantially continuous outside surface and a hollow shaft interior;

a first paddle blade, said first paddle blade being attached to said first shaft end; and a second paddle blade, said second paddle blade being attached to said second shaft end wherein said first end is rotationally displaced about said center axis with respect said second end, whereby said first paddle blade is feathered with respect to said second paddle blade by said rotational displacement.

7. A kayak paddle, as defined by claim 6, further comprising a center core, said center core being disposed within said hollow shaft interior, said segments being formed from at least a first material having a first mass, said center core being formed from a second material having a second mass, said second mass being less than said first mass.

8. A kayak paddle, as defined by claim 7, further comprising a reinforcing material, said reinforcing material being disposed between said center core and said hollow shaft interior, said reinforcing material bonding to said shaft interior forming a substantially rigid interior sleeve.

9. A kayak paddle, as defined by claim 8, wherein said at least two lineal segments further comprise eight lineal segments, said segments having a substantially trapezoidal cross section.

10. A kayak paddle, as defined by claim 9, wherein said segments are formed from wood and said center core is formed from closed cell foam.

11. An elongate hollow shaft having a helical twist therein, said hollow shaft comprising:

at least three lineal segments, each of said segments having a length and a substantially trapezoidal cross section defined by an exterior base, an interior base and two nonparallel legs, each of said two nonparallel legs and said length defining a surface for forming a mating relationship with said surface of another segment, said lineal segments being arranged in side-to-side relationship with each other so that said surfaces are substantially aligned when said lineal segments are joined to form said hollow shaft having a first end, a second end, and an interior, said first end being rotationally displaced with respect to said second end.

12. An elongate hollow shaft, as defined by claim 11, further comprising a center core, said center core being disposed within said interior of said hollow shaft, said lineal segments being formed from at least a first material having a first mass, said center core being formed from a second material having a second mass, said second mass being less than said first mass.

13. An elongate hollow shaft, as defined by claim 12, further comprising a reinforcing material, said reinforcing material being disposed between said center core and said interior of said hollow shaft, said reinforcing material bonding to said interior forming a substantially rigid interior sleeve.

14. An elongate hollow shaft, as defined by claim 12, wherein said segments are formed from wood and said center core is formed from closed cell foam.

15. An elongate hollow shaft, as defined by claim 11, wherein said at least three lineal segments further comprise at least four lineal segments, said lineal segments being formed such that said hollow shaft has an ovular cross section.

16. An elongate hollow shaft, as defined by claim 11, wherein said exterior base is curved.

17. An elongate hollow shaft, as defined by claim 13, wherein said surfaces of said lineal segments arranged in side-to-side relationship define a groove and said interior sleeve is formed from a cloth and an adhesive such that said cloth bridges said groove.

18. An elongate hollow shaft comprising:

at least four lineal segments, each of said segments having a length and a substantially trapezoidal cross section defined by an exterior base, an interior base and two nonparallel legs, each of said two nonparallel legs and said length defining a surface for forming a mating relationship with said surface of another segment, said lineal segments being arranged in side-to-side relationship with each other so that said surfaces are substantially aligned when said lineal segments are joined to form said hollow shaft having an interior and an ovular cross section.

19. An elongate hollow shaft, as defined by claim 18, further comprising a center core, said center core being disposed within said interior of said hollow shaft, said lineal segments being formed from at least a first material having a first mass, said center core being formed from a second material having a second mass, said second mass being less than said first mass.

20. An elongate hollow shaft, as defined by claim 19, further comprising a reinforcing material, said reinforcing material being disposed between said center core and said interior of said hollow shaft, said reinforcing material bonding to said interior forming a substantially rigid interior sleeve.

21. An elongate hollow shaft, as defined by claim 19, wherein said segments are formed from wood and said center core is formed from closed cell foam.

22. An elongate hollow shaft, as defined by claim 18, wherein said exterior base is curved.

23. An elongate hollow shaft, as defined by claim 20, wherein said surfaces of said lineal segments arranged in side-to-side relationship define a groove and said interior sleeve is formed from a cloth and an adhesive such that said cloth bridges said groove.

24. A paddle comprising:

an elongate hollow shaft including at least four lineal segments, each of said segments having a length and a substantially trapezoidal cross section defined by an exterior base, an interior base and two nonparallel legs, each of said two nonparallel legs and said length defining a surface for forming a mating relationship with said surface of another segment, said lineal segments being arranged in side-to-side relationship with each other so that said surfaces are substantially aligned when said lineal segments are joined to form said hollow shaft having an ovular cross section, a first end, a second end, and an interior, at least one of a first paddle blade and a second paddle blade, said first paddle blade being attached to said first end and said second paddle blade being attached to said second end.

25. A paddle, as defined by claim 24, further comprising a center core, said center core being disposed within said interior of said hollow shaft, said lineal segments being formed from at least a first material having a first mass, said center core being formed from a second material having a second mass, said second mass being less than said first mass.

26. A paddle, as defined by claim 25, further comprising a reinforcing material, said reinforcing material being disposed between said center core and said interior of said hollow shaft, said reinforcing material bonding to said interior forming a substantially rigid interior sleeve.

27. A paddle, as defined by claim 25, wherein said segments are formed from wood and said center core is formed from closed cell foam.

28. A paddle, as defined by claim 24, wherein said exterior base is curved.

29. A paddle, as defined by claim 26, wherein said surfaces of said lineal segments arranged in side-to-side relationship define a groove and said interior sleeve is formed from a cloth and an adhesive such that said cloth bridges said groove.

* * * * *

UNITED STATES PATENT AND TRADEMARK OFFICE

CERTIFICATE OF CORRECTION

PATENT NO. : 5,842,830

DATED : December 1, 1998

INVENTOR(S) : Philip C. Franznick

It is certified that error appears in the above-identified patent and that said Letters Patent is hereby corrected as shown below:

In Column 5, Line 1, delete "SA" and insert therefor --5A--.

Signed and Sealed this

Eleventh Day of May, 1999

*Attest:*

Q. TODD DICKINSON

*Attesting Officer*

*Acting Commissioner of Patents and Trademarks*